United States Patent [19]

Tackles

[11] Patent Number: 4,911,316

[45] Date of Patent: Mar. 27, 1990

[54] PLASTIC BOTTLE CAP SEALING PLURAL NECK PROFILES

[75] Inventor: George Tackles, San Jose, Calif.

[73] Assignee: Cap Snap Co., San Jose, Calif.

[21] Appl. No.: 344,616

[22] Filed: Apr. 27, 1989

[51] Int. Cl.[4] ..... B65D 41/48

[52] U.S. Cl. ..... 215/256; 215/319; 215/321

[58] Field of Search ..... 215/256, 319, 321

[56] References Cited

U.S. PATENT DOCUMENTS

| | | | |
|---|---|---|---|
| 3,325,033 | 6/1967 | Wheaton | 215/254 |
| 3,392,862 | 7/1968 | Faulstich | 215/254 |
| 3,653,529 | 4/1972 | Segmuller | 215/256 |
| 3,899,097 | 8/1975 | Aichinger | 215/320 X |
| 4,106,653 | 8/1978 | Martinelli | 215/256 |
| 4,416,383 | 11/1983 | Frahm et al. | 215/256 |

*Primary Examiner*—Donald F. Norton
*Attorney, Agent, or Firm*—Julian Caplan

[57] ABSTRACT

5-gallon plastic molded bottles of at least two manufacturers have neck profiles which differ slightly but have a diameter where the variation in profile is at a minimum. The cap of this invention fits at least two profiles. In each profile there is an outward-convex bead below the top lip. The interior of the skirt of the cap curves concave approximately co-extensive with such bead curvature and has plural circumferential internal annular ridges which engage the bead at about its maximum diameter. Below the ridges is an internal annular tension ring having a diameter when unstressed less than the diameter of the top neck bead at its circle of contact which engages below the maximum bead diameter and hence tends to pull the ridges down into tighter engagement with the profiles of either manufacturers' neck finish. Below the tension ring the skirt is formed with a horizontal tear line which extends about 265° of the circumference of the skirt. A second score line curves down to the bottom edge of the skirt. A tear tab projects down adjacent the terminus of the curved score line. To properly seat the cap on the neck and to reduce resistance to the capping operation, narrow vertical internal ribs radially spaced apart are formed on the inner skirt slightly below the horizontal score line.

5 Claims, 1 Drawing Sheet

PLASTIC BOTTLE CAP SEALING PLURAL NECK PROFILES

CROSS-REFERENCE TO RELATED APPLICATION

Reference is made to Application Ser. No. 205,727, filed 6/13/88, now abandoned, on which this application is an improvement.

BACKGROUND OF THE INVENTION

1. Field of the Invention

This invention relates to a new and improved plastic bottle cap of the type used as a tamper-evident closure for large (e.g., 5-gallon) bottles for water. More particularly, the invention relates to a cap having vertical internal ribs which improve performance during capping by insuring the cap seats on the bottle neck properly and reduces frictional resistance to capping. Further, the invention relates to a cap so constructed that it will securely seal the necks of bottles of different manufacturers having somewhat different neck profiles. There are several manufacturers of such bottles and a number of these manufacturers produce bottles having profiles which differ to an extent, but are generally the same. The cap of the present invention is so constructed that it will seal plural neck profiles. A further feature of the present invention is the fact that the cap will accommodate necks which have been somewhat damaged and still provide a tight seal.

2. Description of Related Art

Heretofore, plastic caps for containers of the general type of 5-gallon water bottles have been closed with caps which accommodate different neck finishes. Thus, caps such as are shown in U.S. Pat. Nos. 3,392,860 and 3,840,137 accommodate neck finishes of the crown and the screw cap variety. Although the caps shown in those references likewise accommodate variations in dimensional thicknesses, the solution to the problem is quite different from that of the present invention.

U.S. Pat. No. 3,392,862 discloses a triangular bead which is seated under the upper neck bead of the bottle. Such a bead was intended to improve the seal of the cap at the point where the ring contacted the neck, rather than for the purpose of the tension ring which is hereinafter disclosed as a feature of the present invention.

U.S. Pat. No. 3,979,002 disclosed ridges which engaged one of the external beads of the bottle neck, but at a different location than that of the present invention.

U.S. Pat. No. 3,840,137 discloses friction rings which engage the under side of the upper neck bead. However, these do not function in the same manner as the friction bead hereinafter disclosed.

The use of plastic bottle caps having an outward bulge in the skirt immediately below the top disc is well known in the art, as is the feature of forming in the skirt of the cap a horizontal scoreline which extends only partially around the circumference of the cap so that when the scoreline is torn there is a connecting area between the upper part of the cap and the torn portion of the skirt which permits the cap to be reinstalled on a bottle neck during transportation back to the bottling works in order to protect the neck from damage during such transportation. The use of second scorelines which extend down from the horizontal scoreline to the bottom edge of the cap and the provision of tear tabs adjacent the termination of such second scoreline are also well known in this art.

SUMMARY OF THE INVENTION

Spaced around the interior of the cap skirt are narrow vertical ribs (here shown as eight in number) located slightly below the horizontal score line. These score lines decrease the frictional resistance to the cap being pushed downward onto the neck during the capping operation. This permits the wall of the cap to be made thinner, thereby reducing the weight of plastic required.

The vertical ribs also assist in seating the cap on the neck straight, whereas in previous cap constructions there have been instances where the cap seated at an angle, resulting in leakage.

As has been stated, several manufacturers produce containers having necks which have a very similar profile but which differ sufficiently in such profiles so that a single cap, even a cap made of a plastic material which is considerably elastic, will not adequately seal different neck profiles. Such neck profiles are generally characterized by the presence immediately below the top lip of an outwardly convex upper bead which merges into a concave groove which, in turn, merges into a second convex bead.

The cap of the present invention resembles prior caps in that it has a top disc which fits close to the top edge of the lip of the neck and a skirt which depends from the disc, the skirt having a bulge at its top which conforms to and preferably seals against the top bead of the neck. The skirt is initially straight below the top bulge and engages the exterior of the second bead of the neck.

In accordance with the present invention, a tension ring is formed on the interior of the skirt in such a location that in order to seat the cap on the neck, the skirt must first stretch so that the tension ring expands to accommodate the upper neck bead and then contracts, seating itself the underside of the convex upper neck bead in such a location that it is biased to slip downwardly-inwardly, sliding along the lower part of the convexity of the top bead and thereby pulling the bulge of the cap downwardly and inwardly toward the upper part of the convexity of the top bead of the neck. Further to augment the sealing action of the cap of the present invention, a plurality of circumferential, thin, vertically spaced apart annular ridges is formed on the interior of the bulge of the cap. Because of the downward-inward biasing of the tension ring, the ridges are pulled into tight sealing engagement with the upper part of the top neck bead and, preferably with its circle of maximum diameter.

In other respects, the cap of the present invention resembles those of prior art in that, immediately below the tension ring, there is a horizontal scoreline which extends approximately 265° around the circumference of the cap, one end of this horizontal scoreline merging with a downward curved second scoreline which extends down to the bottom edge of the cap. Instead of a horizontal scoreline as thus described, the scoreline may extend circumferentially around the entire cap. Adjacent the terminus of the second scoreline is a tear tab preferably having a plurality of transverse gripping ridges.

In use of the device, when the cap is seated on the neck, the tension ring pulls the sealing ridges on the inside of the bulge of the cap against the neck bead, performing a seal which accommodates different profiles of caps and also accommodates variations in dimension due to manufacturing tolerances and damage during wear. When the skirt is intact, it is difficult or impossible to remove the cap without there being evidence of tampering. When it is time to remove the cap, the user grips the tear tab and pulls up along the second scoreline and then around the horizontal scoreline to its end. This permits easy removal of the cap. As a matter of fact, continued pulling on the tear tab, particularly in an upward position, will pull the cap off the neck in a single tearing and removal series of motions. To protect the neck from damage when the container is being returned for refilling, a torn cap may be pushed onto the bottle neck. It will stay on the neck sufficiently securely so that it provides a cushion protecting the finish of the neck from damage f the neck comes in contact with a hard object which might otherwise damage it.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 2:
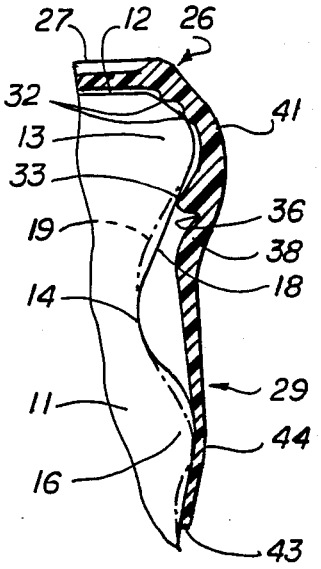
FIG. 2 is an enlarged fragmentary sectional view of a cap seated on a schematic composite of profiles of two different necks.
Figure 4:
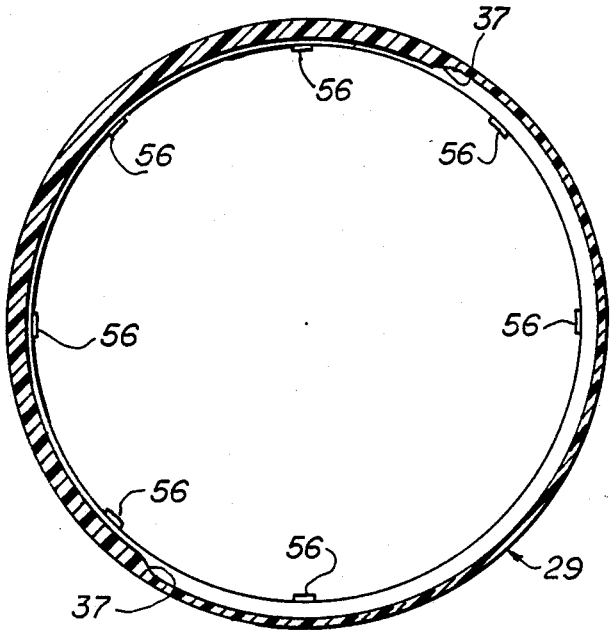
FIG. 4 is a sectional view taken substantially along the line 4—4 of FIG. 1.

A schematic composite neck 11 has a top lip 12, a convex top bead 13 immediately below the lip 12, the bead 13 merging into a concave surface or groove 14 which, in turn, merges with a convex lower bead 16. The portion of the neck below bead 16 is not of concern in connection with the cap of the present invention. As best shown in FIG. 3 and also shown in FIG. 2, the cap hereinafter described accommodates the profiles of at least two different bottle constructions. The solid lines show the profile of a commercial 5-gallon plastic container manufactured by Liquibox Corporation. The dashed line profile is that of a container manufactured by Reid Corporation. The profiles vary from each other as best shown in FIG. 3. However, it will be noted that at point 21 they have a circle of coincidence or, more precisely, a circle of minimal variation. Heretofore, for adequate sealing, different caps have been required for each of the neck profiles or, if a single cap were used, a compromise with proper sealing of at least one of the profiles was required.

Cap 26 of the present invention has a top disc 27 formed with a central internal depression 29. Describing now the interior of the skirt 29 which depends from the disc 27, there is a curved corner 31 spaced slightly outward from the exterior of the top bead 13 and located on such curved corner 31 are annular thin, flexible internal ridges 32 which fit against bead 13.

Formed below the ridges 32 is a large cross-section internal tension ring 33 which engages at the circle of coincidence 21 and down below said circle, where the diameter of the neck is less than the maximum diameter. Expressed otherwise, the tension ring 33 engages the under side of the outward convex top bead 13, whereas the ridges 32 engage the upper side of this bead.

Figure 1:
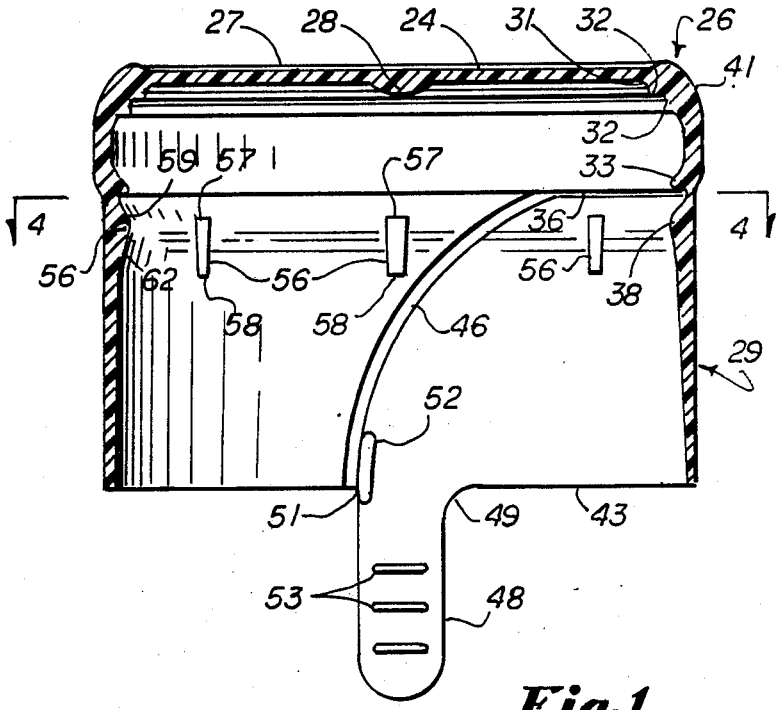
FIG. 1 is a side elevational view of a cap in accordance with the present invention, the same being partially broken away to reveal interior construction.

In the initial unstressed condition of the cap shown in FIG. 1, the lower portion of the skirt 42 extends approximately vertically downward, but at a lesser diameter, to the bottom edge 43.

Figure 3:
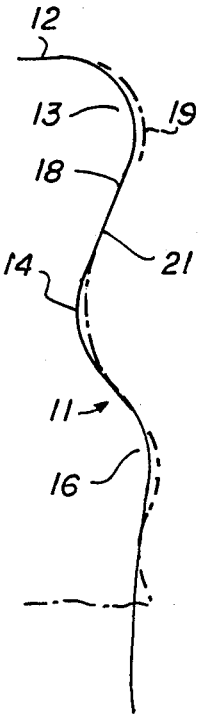
FIG. 3 is an enlarged view showing the profiles of the necks shown in FIG. 2.

When the cap is seated on the neck, as shown in FIG. 2, there is a convex bulge 41. The exterior 42 of the skirt curves inward as shown in FIG. 2 and then bulges outward as indicated by reference numeral 44, being tangent to the lower neck bead 16.

Immediately below tension ring 33 is a horizontal internal indented scoreline 36 which extends approximately 265° around the circumference of the interior of skirt 29 to a terminus 37. Below horizontal scoreline 36, the interior of skirt 29 is formed with a thickening 38 which insures that when the lower portion 42 of the skirt is torn away, the line of tearing will coincide with scoreline 36 rather than curving downwardly relative thereto. Of course, the tension ring 33 prevents the line of tearing from curving upwardly relative to scoreline 36. Curving downwardly toward the bottom edge 43 is a second internal scoreline 46 which is a downward extension of one end of the line 36.

Projecting down from bottom edge 43 to one side of the terminus of scoreline 46 is a tear tab 38. There is a rounded corner 49 between one edge of tab 48 and edge 43 and a square corner 51 on the other side of tear tab 48 which coincides with the lower end of the curved scoreline 46. To assist the consumer in gripping the tab 48, there are preferably transverse gripping ridges 53 (here shown as three in number) on the inside of tab 48. A thickening 52 is formed on the inside of the skirt on the side of score line 46 opposite corner 51. Thickening 52 is narrow and for a short distance upward of edge 43 follows the curvature of scoreline 46 and extends below bottom edge 43 on the inside of tab 48. Thickening 52 resists any tendency of the cap to tear in a location other than along scoreline 46 when the tab 48 is pulled.

Integral with the lower portion of skirt 29 and located on the inside thereof are vertical standoff ribs 56, here shown as eight in number and equally radially spaced apart. Ribs 56 have their upper edges 57 spaced a short distance below the level of horizontal score line 36 and extend downward about 0.35 in. to lower edge 58. The width of the rib is about 0.07 at the top and tapers downwardly. In profile, the upper surface 59 curves downward-inwardly to a maximum 61 to about the midpoint of the length of the rib and the lower surface 62 slants downward-outwardly.

In use of the device, during capping, the cap 26 is pushed down on the neck 11. The lower edges 58 of ribs 56 contact the top bead 13 of neck 11 and align cap 26 properly with the neck so it is straight. Continued downward pressure on the cap causes the ribs to slide over bead and reduce the amount o frictional resistance. Because the strain on the cap is thus reduced, the cap may be made thinner, and thus less expensively. The tension ring 33 expands to clear the top bead 13 and then, by reason of the elasticity of the plastic of which the cap 26 is made, contracts to engage the under side of bead 13 spaced downward from the circle of coincidence 21. As is evident from FIG. 2, the contraction of the ring 33 causes the convex bulge 41 to pull inwardly and downwardly in a "camming" action. This brings the sealing ridges 32 into firm engagement with the exterior of bead 13. By reason of the tension of the ring 33, the variations between the profiles 18 and 19, variations due to manufacturing tolerances, and nicks in the surface of the exterior of the bead 13, as well as wearing away of the bead through use, are all accommodated by the ridges 32 tightly engaging the exterior of the bead 13 above its maximum diameter Despite profile variations, effective sealing of ridges 32 with the maximum diameter of bed 13 and the convex surface above such maximum diameter is achieved. Below the tension ring 33, the lower skirt portion 42 is deformed to bulge outwardly as indicated by reference numeral 44, tightly engaging the exterior of lower bead 16, holding the cap in place and preventing dirt or other contaminants from leaking under the bottom edge 43.

To remove cap 26, evidence of tampering must occur because it cannot normally be removed without tearing skirt 29. In normal usage, when the cap is to be removed, the consumer grips the tab 44 pulling upward, tearing the lower skirt 42 commencing at the corner 51, along the curved scoreline 46 and then merging along the horizontal scoreline 36 to the terminus 37. If the consumer pulls upward on the tab 48 while the tearing occurs, when the terminus 37 is reached, the cap will pull off the neck 11. Frequently, a full container is exchanged for an empty one. In these instances as well as others, it is convenient to use the torn cap 26 to protect the neck of the empty container being returned to the bottling works for reuse. Merely pushing the torn cap down on the neck will hold it in place. Although it is within the scope of the purview of this invention that the horizontal scoreline 36 be continuous throughout 360° of the circumference of the cap, nevertheless terminating the same at terminus 37 is desirable in order to permit tee cap to be used for reclosure purposes.

What is claimed is:

1. A cap for closing a bottle neck of the type having a top outward convex bead immediately below the top lip of the neck and an inward concave indented portion below said top bead, said cap comprising a top disc, a rounded corner at the periphery of said disc, a skirt below said corner having a convex outward bulge below said corner, a thickened-wall tension ring on the interior of said skirt at the lower edge of said bulge, said tension ring being positioned to engage the underside of said top bead when said cap is seated on said neck, said tension ring having an unstressed minimum diameter less than that of said top bead, said tension ring tending to contract and slide down the underside of said top bead and thereby pull said bulge toward engagement with the upper surface of said top bead, said cap further comprising a plurality of narrow, vertical stand-off ribs on the inside of said skirt at about the level of said indented portion when said cap is seated on said neck, said ribs being radially spaced apart, each said rib having an upper edge below said tension ring and a lower edge below said upper edge, the profile of each said rib increasing downward-inwardly to a minimum diameter immediately below said upper edge and then diminishing continuously downward-outwardly to said lower edge, the profile of said rib slanting continuously downwardly-outwardly from said minimum diameter to said lower edge, whereby when said cap is installed on a bottle neck, said ribs center said cap relative to said bottle neck and as said cap is pressed onto said neck said ribs slide over said bead and reduce frictional resistance to said cap sliding over said bead, a lower skirt below said tension ring and tear means to at least partially sever said lower skirt from the portion of said cap above the lower edge of said tension ring, said ribs being located on the inside of said lower skirt.

2. A cap according to claim 1 which further comprises a first annular, thin, flexible ridge on the inside of said bulge, said ridge sealing against said top bead when said tension ring pulls said bulge toward engagement with the upper surface of said top based, and at least one second thin, flexible, annular ridge parallel to and spaced from said first annular ridge.

3. A cap for closing plural profile bottle necks of the type having a top outward convex bead immediately below the top lip of the neck and an inward concave indented portion below said top bead, wherein different necks have different top bead profiles such that the external diameters vary throughout their profiles, said different profiles having circles of maximum diameter and circles of minimum variation spaced on said top bead part-way down from the circle of maximum diameter of said top bead, said cap comprising a top disc, a rounded corner at the periphery of said disc, a skirt below said corner having a convex outward bulge below said corner, a thickened-wall tension ring on the interior of said cap at the lower edge of said bulge and substantially below the level of said circle of maximum diameter of said top bead, said tension ring being positioned to engage the underside of said top bead in a circle of contact when said cap is seated on said neck, said tension ring having an unstressed minimum diameter less than that of said circle of contact, whereby, as said cap is applied to a bottle neck, said tension ring stretches and after said cap is seated on said neck with said top disc engaging the top lip of said neck, said tension ring contracts and slides down the underside of said top bead and thereby pulls said bulge toward tight engagement with the upper surface and maximum diameter of said top bead, said cap further comprising a plurality of narrow, vertical stand-off ribs on the inside of said skirt at about the level of said indented portion when said cap is seated on said neck, said ribs being radially spaced apart, each said rib having an upper edge below said tension ring and a lower edge below said upper edge, the profile of each said rib increasing downward-inwardly to a minimum diameter immediately blow said upper edge and then diminishing continuously downward-outwardly to said lower edge, the profile of said rib slanting continuously downwardly-outwardly from said minimum diameter to said lower edge, whereby when said cap is installed on a bottle neck, said ribs center said cap relative to said bottle neck and as said cap is pressed onto said neck said ribs slide over said bead and reduce frictional resistance to said cap sliding over said bead, a lower skirt below said tension ring and tear means to at least partially sever said lower skirt from the portion of said cap above the lower edge of said tension ring, said ribs being located on the inside of said lower skirt.

4. A cap according to claim 3 in which said cap further comprises a first annular, thin, flexible ridge on the inside of said bulge located above said circle of maximum diameter, and at least one second thin, flexible, annular ridge parallel to and spaced from said first annular ridge, said ridge being parallel to and spaced from each other, said ridges sealing against said top bead when said tension ring pulls said bulge toward engagement with the upper surface of said top bead.

5. In combination, a bottle neck of the type comprising a top outward convex bead immediately below the top lip of the neck and an inward concave intended portion below said top bead, wherein different neck styles have different said top bead shapes such that the external diameters of said shapes vary throughout their profiles, said different shapes having circles of minimum variation spaced on said top bead part-way down from a circle of maximum diameter of said top bead, and a cap for closing said neck, comprising a top disc, a rounded corner at the periphery of said disc, a convex outward bulge below said corner, a thickened-wall tension ring on the interior of said cap at the lower edge of said bulge and substantially below the level of said circle of maximum diameter of said top bead, said tension ring being positioned to engage the underside of said top bead in a circle of contact, said tension ring having an unstressed minimum diameter before seating less than that of said circle of contact, whereby, as said cap is applied to said neck, said tension ring stretches and after said cap is seated on said neck with said top disc engaging the top lip of said neck, said tension ring contracts and slides down the underside of said top bead and thereby pulls said bulge toward tight engagement with the upper surface and maximum diameter of said top bead, a plurality of annular, thin, flexible ridges on the inside of said bulge located above said circle of maximum diameter, said ridges being parallel to and spaced from each other, said ridges sealing against said top bead when said tension ring pulls said bulge toward engagement with the upper surface of said top bead, said cap further comprising a plurality of narrow, vertical stand-off ribs on the inside of said skirt at about the level of said indented portion of said neck, said ribs being radially spaced apart, each said rib having an upper edge below said tension ring and a lower edge below said upper edge, the profile of each said rib increasing downward-inwardly to a minimum diameter immediately blow said upper edge and then diminishing continuously downward-outwardly to said lower edge, the profile of said rib slanting continuously downwardly-outwardly from said minimum diameter to said lower edge, whereby when said cap is installed on said bottle neck, said ribs center said cap relative to said bottle neck and as said cap is pressed onto said neck said ribs slide over said top bead and reduce frictional resistance to said cap sliding over said top bead, a lower skirt below said tension ring and tear means to at least partially sever said lower skirt from the portion of said cap above the lower edge of said tension ring, said ribs being located on the inside of said lower skirt.

* * * * *